US005177976A

United States Patent [19]

Lim et al.

[11] Patent Number: 5,177,976

[45] Date of Patent: Jan. 12, 1993

[54] CONTROL APPARATUS FOR FREEZING CHAMBER OF A REFRIGERATOR

[75] Inventors: Jae H. Lim, Suweon; Myung W. Kim, Seoul; Gi J. Jeong, Suweon, all of Rep. of Korea

[73] Assignee: Samsung Electronics Co., Ltd., Suwon, Rep. of Korea

[21] Appl. No.: 756,039

[22] Filed: Sep. 6, 1991

[30] Foreign Application Priority Data

Sep. 12, 1990 [KR] Rep. of Korea ..... 90-14088

[51] Int. Cl.[5] ..... F25B 49/00

[52] U.S. Cl. ..... 62/131; 62/440; 362/92; 362/94

[58] Field of Search ..... 62/131, 229, 440, 465; 362/92, 94; 236/51

[56] References Cited

U.S. PATENT DOCUMENTS 2,152,486 11/1936 Knight ..... 326/94

2,385,525 2/1943 McCloy ..... 62/131

*Primary Examiner*—John Sollecito

*Attorney, Agent, or Firm*—Robert E. Bushnell

[57] ABSTRACT

A control apparatus for maximizing an inner space of a freezing chamber of a refrigerator and for providing ready access to a temperature control portion even when the inner space is filled with foodstuffs. The apparatus includes an upper cover recessed into an upper wall of the freezer chamber to contain the temperature control portion and a lamp, a case having a temperature adjustment lever an illumination cover protecting lamp, in which the temperature adjustment lever is engaged with a follower gear of the temperature control portion to control the temperature of the freezing chamber.

7 Claims, 4 Drawing Sheets

CONTROL APPARATUS FOR FREEZING CHAMBER OF A REFRIGERATOR

BACKGROUND OF THE INVENTION

The invention is related to provide a freezing chamber of a refrigerator, and particularly to provide a control apparatus for a freezing chamber of a refrigerator for automatically controlling the temperature in the freezing chamber followed by the temperature detection and the on-off operation control of a compressor.

A conventional refrigerator includes a thermostat module for automatically controlling any one and/or both of the temperatures in the freezing chamber and the refrigerating chamber, and a damper system for supplying/shutting off cooling air to automatically adjust the temperature in the refrigerating chamber, in which the thermostat module is generally configured to sense the temperature in both chambers and then control the freezing cycle of the refrigerator including an evaporator, a condenser, a compressor and a capillary tube.

Especially, the adjustment of the freezing chamber has been accompanied with a separate temperature control portion constituting part of the thermostat module. The illumination in the freezing chamber has been achieved by a lamp installed far away from the temperature control portion, in which the lamp is turned on/off according to the opening/closing of a freezing door with a contact switch such as a limit switch being mounted near the door.

Further, not only the temperature control portion but also the lamp is mounted projecting inward from the rear wall or any one of the side walls of the freezing chamber at different positions. Therefore, it was deterrent to the space efficiency in the freezing chamber resulting in the limitation of its use. For example, the fully stocked frozen foodstuffs cause difficulties to the user in gaining access to the temperature control portion of the temperature control and deteriorates its illuminating effect in the freezing chamber.

Accordingly, the invention is to improve the configuration of a conventional temperature control portion projected into a freezing chamber of a refrigerator along with a temperature adjustment manual lever or handle.

One object of the invention is to provide a control apparatus of a freezing chamber integrated with an illuminating lamp to maximize the space efficiency, the control apparatus being placed into any one of the inner walls.

Another object of the invention is to provide a control apparatus of a freezing chamber mounted adjacent to the door for facilitating the temperature adjustment with a manual lever or handle being projected forward.

Yet another object of the invention is to provide a control apparatus of a freezing chamber for effectively illuminating the retainer lamp.

SUMMARY OF THE INVENTION

In order to accomplish these objects and features of the invention, a control apparatus of a freezing chamber includes:

a case mounted to be exposed at a predetermined minimum height in the freezing chamber, an upper cover portion recessed into an upper wall of the freezing chamber to receive a temperature control portion and an illumination lamp extending downward at a predetermined distance away from the case, the temperature control portion having a rotation shaft mounted in a box to control the on-off operation of a compressor so as to adjust the temperature in the freezing chamber, a device for supporting the rotation shaft along with a follower gear, an inserting hole perforated to enable the illumination lamp to be passed through the case, a temperature adjustment device engaged at one end with the follower gear of the rotation shaft between the predetermined height of the case, one end being formed as a sector rack and other end being constructed as an adjustment knob, a pivot coupling device configured in the case to rotate the temperature adjustment device at a sector shaft according to the reciprocation sliding of the manual adjustment knob, and a lower illuminating cover coupled with the case to illuminate the freezing chamber at the lower position of the case.

According to the invention, a control apparatus for a freezing chamber of a refrigerator leads the temperature adjustment lever to be projected from the upper wall adjacent to the door, so that it is slidable in an elongated guide rail formed at the front of the case. It removes the inconveniences for drawing the storaged foodstuffs out of the freezing chamber in order to control the temperature. Also, the installment of the control apparatus within the wall induces the use of the enhanced space efficiency in the freezing chamber.

BRIEF DESCRIPTION OF THE INVENTION

The invention will be explained in detail below with reference to the accompanying drawings, in which.

DETAILED DESCRIPTION OF THE INVENTION

Figure 1:
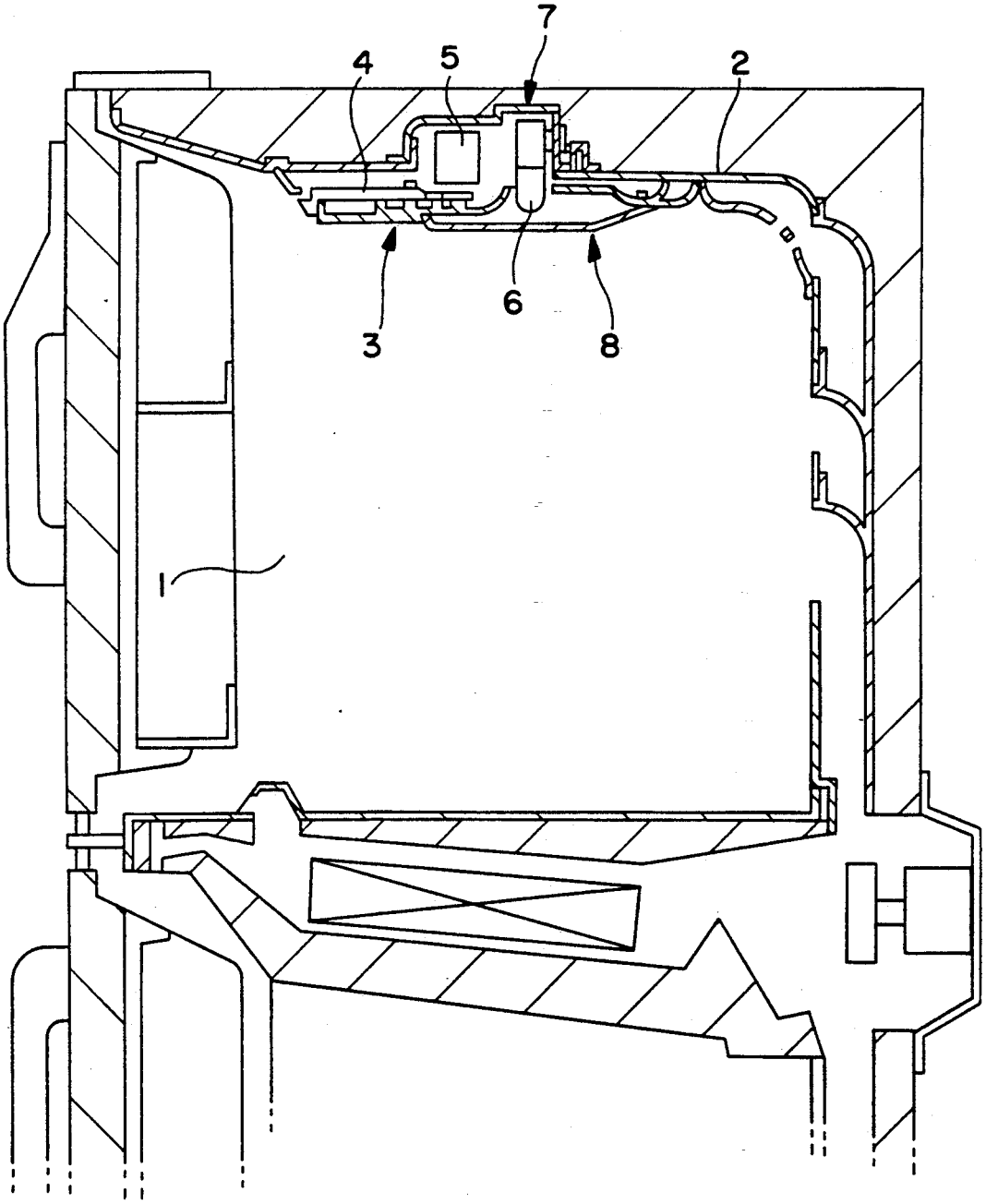
FIG. 1 is a cross-sectional view showing the mounting of a control apparatus for a freezing chamber of a refrigerator in the freezing chamber according to the invention.

Referring to FIG. 1, a control apparatus for a freezing chamber of a refrigerator is mounted on the upper wall on the ceiling 2 of the freezing chamber 1. The control apparatus includes a case 3, an upper cover 7 and an illumination cover 8. The case 3 is mounted at a low profile to the upper wall of the freezing chamber 1 cooperating with the upper cover 7 to be exposed at a minimum distance to the upper cover 7, while being configured to position a temperature control portion 5 connected to a temperature adjustment lever 4 as described below in detail and an illumination lamp 6 to properly be seated thereon. The upper cover 7 is recessed in the upper wall of the ceiling 2 with the temperature portion 5 and the illumination lamp 6 being received, while being fixed and cooperating with the inner periphery liner of the upper wall and the case 3. The illumination cover 8 is attached to the lower portion of the case 3.

Figure 2:
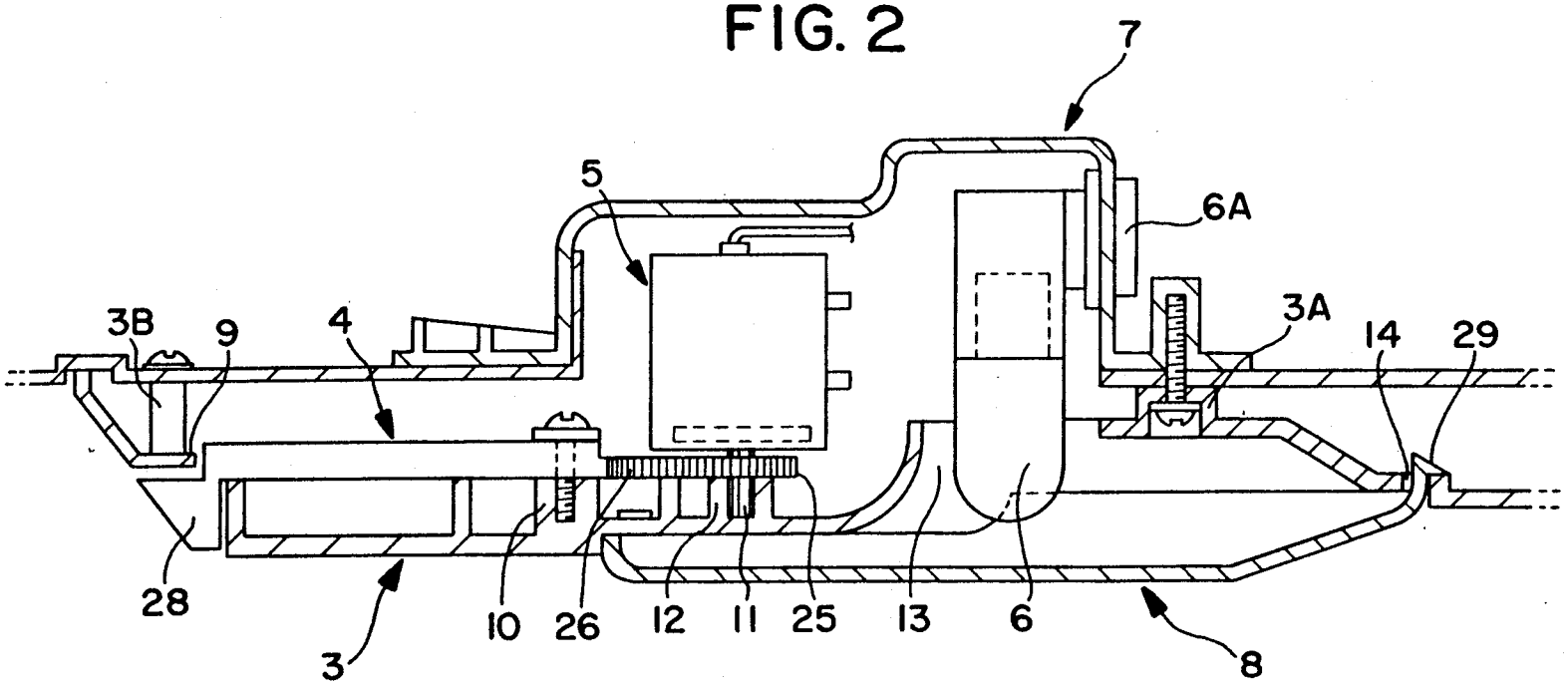
FIG. 2 is an enlarged cross-sectional view showing a control apparatus according to the invention.
Figure 3:
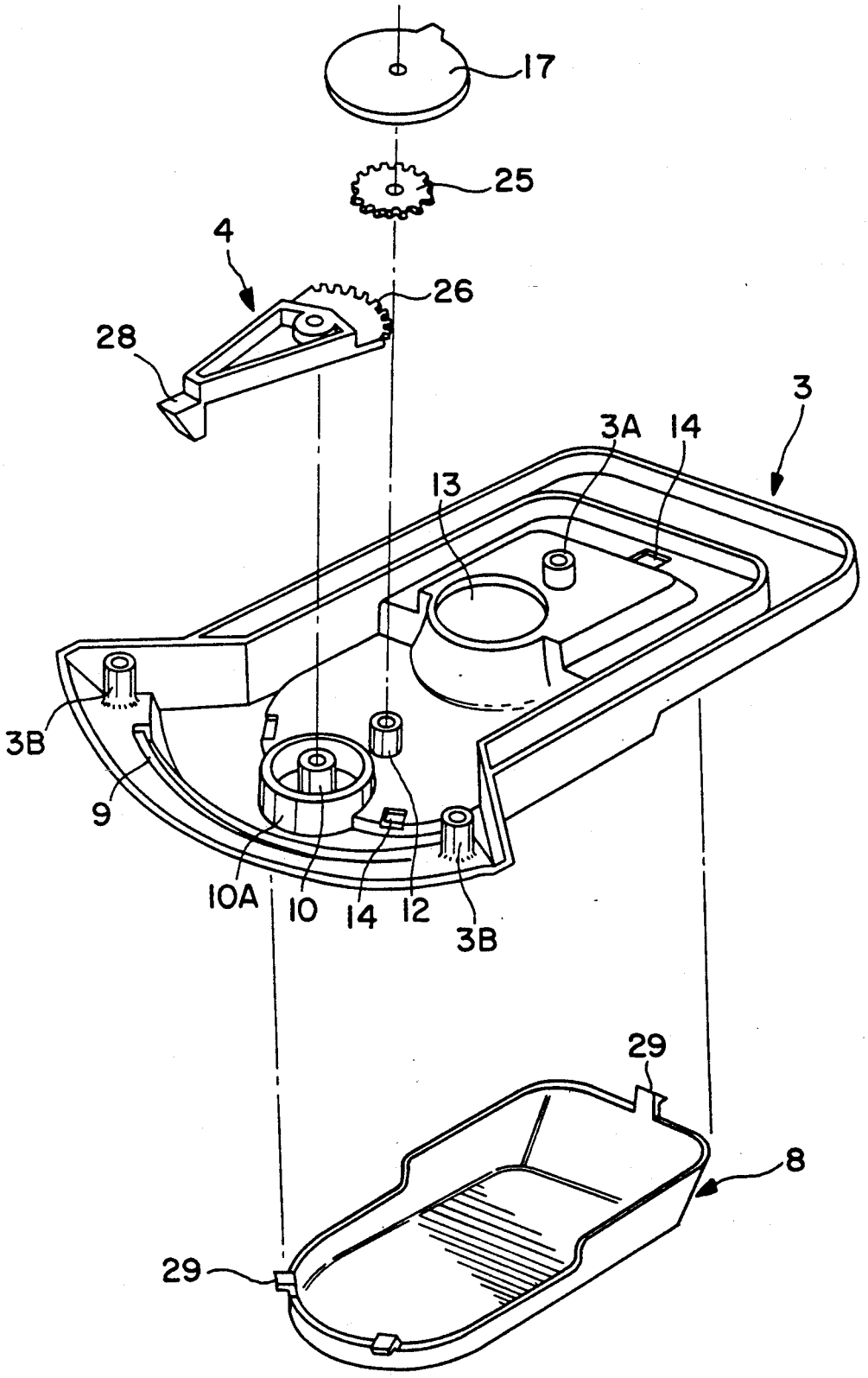
FIG. 3 is an exploded perspective view showing a control apparatus including a temperature adjustment lever, a case and a lower illuminating cover according to the invention.

FIG. 2 is a view enlarging the control apparatus of FIG. 1 and FIG. 3 is an exploded perspective view showing the assembly of the case and an illumination cover according to the control apparatus of the invention.

An upper cover 7 recessed in the upper wall of a ceiling 2 is mounted in a manner to properly be positioned over the inner liner of the upper wall or through a screw to the upper wall along with the case 3. A socket 6A is fixed to the rear inner wall of the upper cover 7 to receive an illumination lamp 6. Herein, it is noted that the upper cover 7 assures the inner space enough to contain the temperature control portion 5 and the illumination lamp 6.

A case 3 includes an outmost frame 30 and an inner frame 31 with their heights being the same level, and a temperature adjustment lever 4 associated with a temperature control portion 5 as described below in detail, in which the temperature adjustment lever 4 is divided into a sector rack 26, a body 4A having a pivot portion 27 adjacent to the sector rack 26 and a knob enabling the lever 4 to be manually slid leftward and rightward, but they are integrated into one unit. Also, the case 3 is integrally moulded into a recessed portion positioning the lever 4 therein and a rising portion having an inserting hole 13 to pass through the top portion of the illumination lamp 6. The recessed portion includes a lever guide opening portion 9 formed along the front step portion of the case 3 almost over its total width, a coupling portion 10 coupled with the pivot portion 27 and a supporting portion 12 supporting a rotation shaft 11 of the temperature control portion 5. The lever guide opening portion 9 is perforated to be able to insert the sector rack 26 and the body 4A. The coupling portion 10 is formed to correspond to the position of the pivot portion 27, around the periphery of which a circle supporter 10A is projected upward by a predetermined distance to support the body 4A. The supporting portion 12 is formed to engage the sector rack 26 with a follower gear 25, which is coupled to the rotation shaft 11. The step portion has two fixing portions 3B at both sides of the lever guide opening portion 9 so as to fix the case 3 to the ceiling 2. The rising portion is raised to mount the fixing portion 3A through the inner liner of the upper wall to the ceiling 2 by means of a screw, so that the illumination lamp 6 is projected downward by the raised height from the upper cover 7 through the inserting hole 13. And coupling holes 14 are perforated near both sides of the circle supporter 10A and the front portion of the inner frame 31 so as to couple the illumination cover 8 with case 2.

The illumination cover 8 is molded of a transparent material in the form of a trough flushing its bottom with that of the case 3. The illumination cover 8 has two hook members at the front and one hook member at the rear, which are respectively inserted into the coupling holes 14, to be mounted on the lower part of the raised portion to protect the illumination lamp 6.

Figure 4:
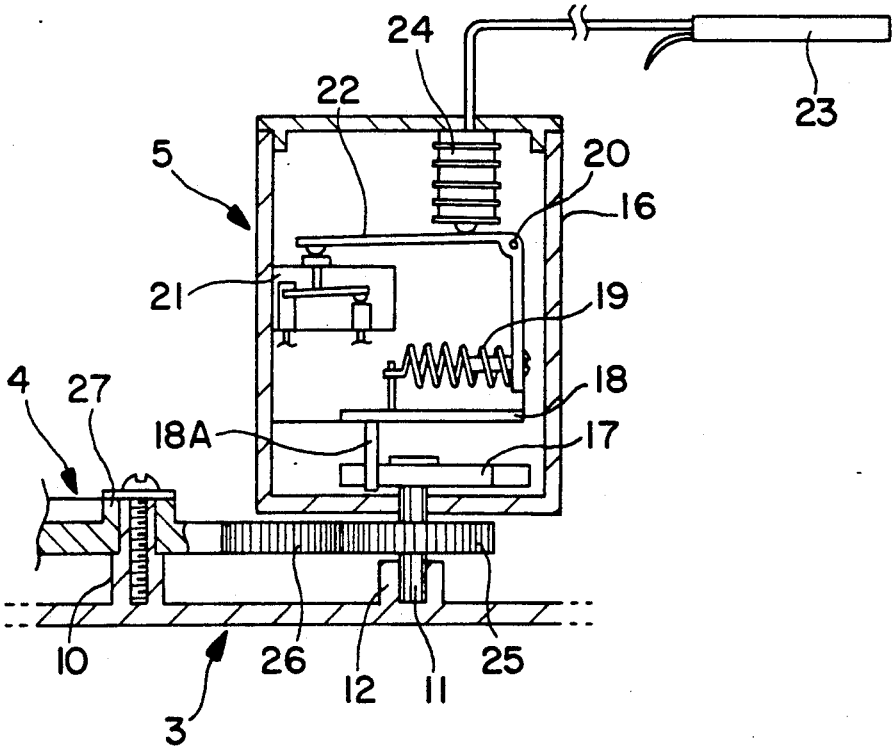
FIG. 4 is a cross-sectional view showing the connection of a temperature control portion to a compressor in addition to the temperature adjustment lever according to the invention.

On the other hand, as shown in FIG. 4, a temperature control portion 4 constitutes a box type configuration according to the prior art. A box 16 is followed in sequence by a bellows 24, an operating lever 22, a control switching portion 21 electrically connected to a compressor (not shown), a spring member 19, an adjustment rod 18, a follower rod 18A, a circle plate cam 17 and a rotation shaft 11 in a vertical arrangement therein. Namely, The bellows 24 is connected at one end to a temperature sensor 23 for expanding/contracting according to the temperature sensed in the freezing chamber and connected at another end with the operating lever 22. The operating lever 22 is made into the right angle form by reference of the pivot point of a pin 20, one end of which is mounted to control the operating of the switching portion 21 and the other end of which is coupled by means of a bolt with one end of the spring member 19. The spring member 19 is attached at the other end to the follower rod 18A mounted to move in horizontal. The follower rod 18A is extended in contact with the outer periphery of the circle plate cam 17. The circle plate cam 17 is fixed to one end of thr rotation shaft 11, which is retained at the supporting portion 12 of the case 3 passing through the bottom of the box 16. The rotation shaft 11 has the follower gear 25 engaged with the sector rack 26.

Therefore, the temperature portion 5 is assembled to position the follower rod 18A at the maximum lift point of the circle plate cam 17, so that the spring member 19 is maximumly expanded, when a temperature adjustment lever 4 is fixed at the most left side of a lever guide opening portion 9 in FIG. 3, in the case that of setting the temperature of the freezing chamber 1 to a predetermined highest point. Otherwise, when a temperature adjustment lever 4 is fixed at the most right side of the lever guide opening portion 9 in the case of setting the temperature of the freezing chamber 1 to a predetermined lowest point, the follower rod 18A is positioned at the minimum lift point of the circle plate cam 17 to return the spring member 19 to a least expanded position.

The upper cover 7 is mounted into the upper wall of the ceiling 2 with the socket 6A having the illumination lamp 6. The temperature control portion 5 is positioned at the supporting portion 12 through the rotation shaft 11 having the follower gear 25. The temperature adjustment lever 4 is inserted into the lever guide opening portion 9 starting from the sector rack 26, so that the pivot point 27 is pivotally fixed at the coupling portion 10 to engage with the sector rack 26. Then, the case 3 is mounted at the fixing portions 3B by means of screws to the ceiling 2 as well as coupled at the fixing portion 3A by means of a screw with the upper cover 7, such that the temperature control portion 5 and the illumination lamp 6 are retained in the space of the upper cover 7. The illumination cover 8 is finally mounted below the case 3 by inserting the hook members 29 into the coupling holes 14, respectively.

The disclosed invention controls the temperature of the freezing chamber 1. Firstly, the temperature control lever 4 is manually slid to decrease the temperature of the freezing chamber by changing a position of the operating lever 19 so the bellows 24 is expanded, and so the switching portion 21 is closed to operate a compressor until the sensing temperature of the sensor 23 reaches the desired predetermined temperature. Thereafter, the bellows 24 is contacted at below the desired predetermined temperature to the position change of the operating lever 22, so that the switching portion 21 is turned off to stop the operation of the compressor. The repetition of such an angle change during the pivoting of the operating lever 22 is automatically performed to control the temperature of the freezing chamber 1.

Accordingly, the invention can be constructed adjacent to the front of a refrigerator door to protrude downward into the freezing chamber by only the side height of a temperature control lever. It utilizes the inner space of a freezing chamber with proper illumination at a maximum without the need for drawing out the stored foodstuffs to change the freezing chamber temperature.

What is claimed is:

1. A control apparatus for a freezing chamber of a refrigerator, comprising:

a case mounted with a low profile to be exposed at a predetermined minimum distance to an upper cover portion;

the upper cover portion recessed into an upper wall of the freezing chamber to receive a temperature control portion and an illumination lamp extending from the case;

the temperature control portion having a rotation shaft mounted in a box to control an on-off operation of a compressor so as to adjust a temperature in the freezing chamber;

means for supporting the rotation shaft along with a follower gear;

an inserting hole perforated to enable the illumination lamp to be passed through the case;

a temperature adjustment means engaged at one end with the follower gear, the one end being formed as a sector rack and an other end being constructed as an adjustment knob;

a pivot coupling means configured in the case to rotate the temperature adjustment means according to a reciprocating sliding of the adjustment knob; and a lower illuminating cover coupled with the case to illuminate the freezing chamber.

2. The control apparatus of claim 1, in which the upper cover portion retains both the temperature control portion and the illumination lamp.

3. The control apparatus of claim 1, in which said predetermined minimum distance to an upper cover portion includes a width of the upper cover portion and a width of a raised portion being limited by a side height of the temperature adjustment means.

4. A control apparatus for a freezing chamber of a refrigerator, said control apparatus comprising:

means for enclosing the control apparatus, said enclosing means being disposed to protrude at a low profile from an inner surface of the freezing chamber;

a recessed portion recessed into the inner surface to receive a temperature control portion and a lamp;

the temperature control portion connected to means for turning a compressor on and off to adjust a temperature in the freezing chamber;

an inserting hole in the enclosing means perforated to enable the lamp to be passed through the case;

temperature adjustment means connected to a first end of the temperature control portion located adjacent to a door of the freezing chamber, for enabling manual selection of a predetermined temperature of the freezing chamber; and a translucent lamp cover coupled with the case to illuminate the freezing chamber.

5. The control apparatus of claim 4, further comprising:

a shaft mounted in a box in the temperature control portion for controlling the compressor;

means for supporting the shaft; and a sector rack engaging with the temperature control portion at a second end of the temperature adjustment means.

6. The control apparatus of claim 4, further comprising:

an adjustment knob being the first end of the temperature adjustment means; and pivot coupling means for providing pivoting of the temperature adjustment means in accordance with movement of the adjustment knob.

7. The control apparatus of claim 5, further comprising:

an adjustment knob being the first end of the temperature adjustment means; and pivot coupling means for providing pivoting of the temperature adjustment means in accordance with movement of the adjustment knob.

* * * * *

UNITED STATES PATENT AND TRADEMARK OFFICE

CERTIFICATE OF CORRECTION

PATENT NO. : 5,177,976

DATED : January 12, 1993

INVENTOR(S) : Jae Hoon Lim, et al

It is certified that error appears in the above-indentified patent and that said Letters Patent is hereby corrected as shown below:

On the title page: Item [75]

change "Jae H. Lim" to -- Jae Hoon Lim--, change "Myung W. Kim" to-- Myung Wouk Kim--;

change "Gi J. Jeong" to --Gi Joong Jeong--:

UNITED STATES PATENT AND TRADEMARK OFFICE

CERTIFICATE OF CORRECTION

PATENT NO. : 5,177,976

DATED : January 12, 1993

INVENTOR(S) : Jae Hoon Lim, et al

It is certified that error appears in the above-indentified patent and that said Letters Patent is hereby corrected as shown below:

| | | |
|---|---|---|
| Column 4 | Line 15, | Preceding "rotation", change "thr" to --the--; |
| | Line 53 | After "chamber 1.", change "Firstly" to --First--; |
| | Line 60, | After "is", change "contacted" to --contracted--: |

Signed and Sealed this

Ninth Day of April, 1996

Bruce Lehman

*Attest:*

BRUCE LEHMAN

*Attesting Officer*

*Commissioner of Patents and Trademarks*